US007946639B2

(12) United States Patent
Bridges et al.

(10) Patent No.: US 7,946,639 B2
(45) Date of Patent: May 24, 2011

(54) SERVER SYSTEM LIFTING DEVICE AND METHOD OF USE

(75) Inventors: John W. Bridges, Pflugerville, TX (US); Matthew C. Cain, Austin, TX (US); Matthew J. Hobbs, Cedar Park, TX (US)

(73) Assignee: Dell Products, LP, Round Rock, TX (US)

( * ) Notice: Subject to any disclaimer, the term of this patent is extended or adjusted under 35 U.S.C. 154(b) by 369 days.

(21) Appl. No.: 12/179,180

(22) Filed: Jul. 24, 2008

(65) Prior Publication Data

US 2010/0019520 A1 Jan. 28, 2010

(51) Int. Cl.
*A45F 5/00* (2006.01)

(52) U.S. Cl. ..... 294/152

(58) Field of Classification Search ..... 294/15, 294/140, 141, 151, 152, 157; 229/117.11, 229/117.19

See application file for complete search history.

(56) References Cited

U.S. PATENT DOCUMENTS 4,657,611 A * 4/1987 Guins ..... 156/157
4,950,014 A * 8/1990 Smith ..... 294/152
5,713,510 A * 2/1998 Walton ..... 229/117.11
6,112,960 A * 9/2000 Seering et al. ..... 224/158
6,196,229 B1 * 3/2001 Piazza ..... 128/869
6,289,534 B1 * 9/2001 Hakamiun et al. ..... 5/89.1
6,581,998 B1 * 6/2003 Clemens ..... 294/141
6,648,388 B2 11/2003 Fredriksson
6,805,660 B1 * 10/2004 Finch ..... 493/218
2006/0017299 A1 * 1/2006 Halvorsen ..... 294/152
2006/0042007 A1 * 3/2006 Kohn et al. ..... 5/114
2007/0120386 A1 5/2007 Benysh et al.

* cited by examiner

*Primary Examiner* — Saúl J Rodriguez
*Assistant Examiner* — Stephen Vu
(74) *Attorney, Agent, or Firm* — Larson Newman, LLP

(57) ABSTRACT

A server system lifting device includes a bearing area foldable at a midline. The bearing area includes a front portion and a rear portion that are defined by the midline. A plurality of handles are coupled to the bearing area. The plurality of handles includes two front handles coupled to opposite sides of the front portion of the bearing area and two rear handles coupled to opposite sides of the rear portion of the bearing area. The midline extends between the opposite sides. The bearing area is characterized by a width greater than or equal to a width of a server system chassis and a length such that the two forward handles are forward of a center of gravity of the server system chassis, and the two rear handles are posterior to the center of gravity, when the midline is approximately aligned with the center of gravity.

20 Claims, 5 Drawing Sheets

SERVER SYSTEM LIFTING DEVICE AND METHOD OF USE

FIELD OF THE DISCLOSURE

This disclosure relates generally to devices and methods to lift server systems.

DESCRIPTION OF THE RELATED ART

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements can vary between different applications, information handling systems can also vary regarding what information is handled, how the information is handled, how much information is processed, stored, or communicated, and how quickly and efficiently the information can be processed, stored, or communicated. The variations in information handling systems allow for information handling systems to be general or configured for a specific user or specific use such as financial transaction processing, airline reservations, enterprise data storage, or global communications. In addition, information handling systems can include a variety of hardware and software components that can be configured to process, store, and communicate information and can include one or more computer systems, data storage systems, and networking systems.

BRIEF DESCRIPTION OF THE DRAWINGS

Skilled artisans appreciate that elements in the figures are illustrated for simplicity and clarity and have not necessarily been drawn to scale. For example, the dimensions of some of the elements in the figures may be exaggerated or minimized relative to other elements to help to improve understanding of embodiments of the disclosed apparatus. Embodiments incorporating teachings of the present disclosure are illustrated and described with respect to the drawings presented herein.

DETAILED DESCRIPTION

Figure 1:
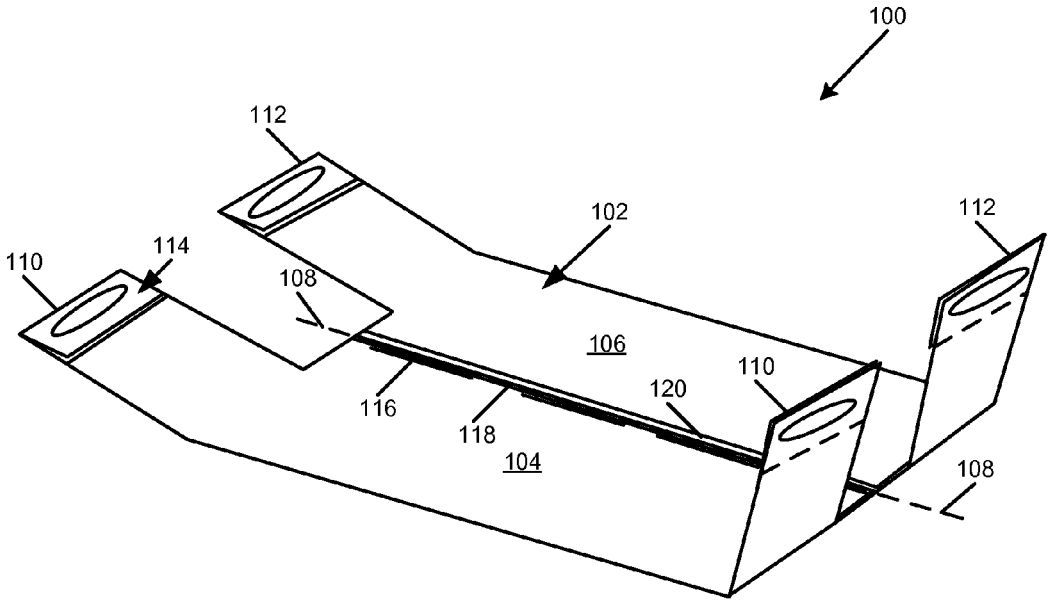
FIG. 1 is a diagram illustrating a particular embodiment of a server system lifting device.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be utilized in this application. The teachings can also be utilized in other applications and with several different types of architectures such as distributed computing architectures, client/server architectures, or middleware server architectures and associated components.

For purposes of this disclosure, an information handling system can include any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a PDA, a consumer electronic device, a network server or storage device, a switch router, wireless router, or other network communication device, or any other suitable device and can vary in size, shape, performance, functionality, and price. The information handling system can include memory (volatile (e.g. random access memory, etc.), nonvolatile (read only memory, flash memory etc.) or any combination thereof), one or more processing resources, such as a central processing unit (CPU), hardware or software control logic, or any combination thereof. Additional components of the information handling system can include one or more storage devices, one or more communications ports for communicating with external devices as well as various input and output (I/O) devices, such as a keyboard, a mouse, a video display, or any combination thereof. The information handling system can also include one or more buses operable to transmit communications between the various hardware components.

Although referred to as a "device," the device may be configured as hardware, firmware, software, or any combination thereof. For example, the device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device). Similarly, the device could be firmware (such as any software running on an embedded device, a Pentium class or PowerPC™ brand processor, or other such device) or software (such as any software capable of operating in the relevant environment). The device could also be a combination of any of the foregoing examples of hardware, firmware, or software.

Devices or programs that are in communication with one another need not be in continuous communication with each other unless expressly specified otherwise. In addition, devices or programs that are in communication with one another may communicate directly or indirectly through one or more intermediaries.

Embodiments discussed below describe, in part, distributed computing solutions that manage all or part of a communicative interaction between network elements. In this context, a communicative interaction may be intending to send information, sending information, requesting information, receiving information, receiving a request for information, or any combination thereof. As such, a communicative interaction could be unidirectional, bi-directional, multi-directional, or any combination thereof. In some circumstances, a communicative interaction could be relatively complex and involve two or more network elements. For example, a communicative interaction may be "a conversation" or series of related communications between a client and a server—each network element sending and receiving information to and from the other. Whatever form the communicative interaction takes, the network elements involved need not take any specific form. A network element may be a node, a piece of hardware, software, firmware, middleware, some other component of a computing system, or any combination thereof.

In the description below, a flow-charted technique may be described in a series of sequential actions. The sequence of the actions and the party performing the steps may be freely changed without departing from the scope of the teachings. Actions may be added, deleted, or altered in several ways. Similarly, the actions may be re-ordered or looped. Further, although processes, methods, algorithms or the like may be described in a sequential order, such processes, methods, algorithms, or any combination thereof may be operable to be performed in alternative orders. Further, some actions within a process, method, or algorithm may be performed simultaneously during at least a point in time (e.g., actions performed in parallel), can also be performed in whole, in part, or any combination thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single device is described herein, more than one device may be used in place of a single device. Similarly, where more than one device is described herein, a single device may be substituted for that one device.

Unless otherwise defined, all technical and scientific terms used herein have the same meaning as commonly understood by one of ordinary skill in the art to which this invention belongs. Although methods and materials similar or equivalent to those described herein can be used in the practice or testing of embodiments of the present invention, suitable methods and materials are described below. All publications, patent applications, patents, and other references mentioned herein are incorporated by reference in their entirety, unless a particular passage is cited. In case of conflict, the present specification, including definitions, will control. In addition, the materials, methods, and examples are illustrative only and not intended to be limiting.

To the extent not described herein, many details regarding specific materials, processing acts, and circuits are conventional and may be found in textbooks and other sources within the computing, electronics, and software arts.

FIG. 1 illustrates a particular embodiment of a server system lifting device 100. The server system lifting device 100 includes a bearing area 102 to support a server system chassis. The bearing area 102 is foldable at a midline 108 that extends between opposite sides of the bearing area 102. The midline 108 defines a front portion 104 of the bearing area 102 and a rear portion 106 of the bearing area 102. The midline 108 can be approximately a centerline of the lifting device 100 or another bisecting midline of the lifting device 100. In a particular embodiment, the midline 108 can include a crease 118 in the material of the bearing area 102. For example, the crease 118 can include a substantially continuous pleat 120 or a plurality of non-continuous slits 116 or other openings 116 in the material of the bearing area 102. The crease 118 can be adapted to promote the foldability of the lifting device 100 at the midline 108.

The lifting device 100 also includes a plurality of handles 110, 112. The plurality of handles includes two front handles 110 coupled to opposite sides of the front portion 104 of the bearing area 102. Additionally, the plurality of handles includes two rear handles 112 coupled to opposite sides of the rear portion 106 of the bearing area 102. In one embodiment, the plurality of handles 110, 112 can be affixed to the bearing area 102. In another embodiment, the bearing area 102 and the plurality of handles 110, 112 can be of unitary construction.

For example, the lifting device 100 can be constructed unitarily of fiberboard or plastic, such as corrugated fiberboard or corrugated plastic having a plurality of flat linerboards and at least one corrugated sheet. In an illustrative, non-limiting embodiment, the corrugated fiberboard or corrugated plastic can be cross-corrugated, such that it includes a corrugated sheet having flutes extending in a first direction and a second corrugated sheet having flutes extending in a second direction, such as at a right angle to the first direction or at another angle to the first direction. In other examples, the lifting device 100 can comprise another material or multiple materials.

In a particular embodiment, each handle 110, 112 can be reinforced. For instance, material used to form each handle 110, 112 can be folded over at its end, such that a grip portion 114 of each handle comprises a double or other multiple portion of the material.

Figure 2:
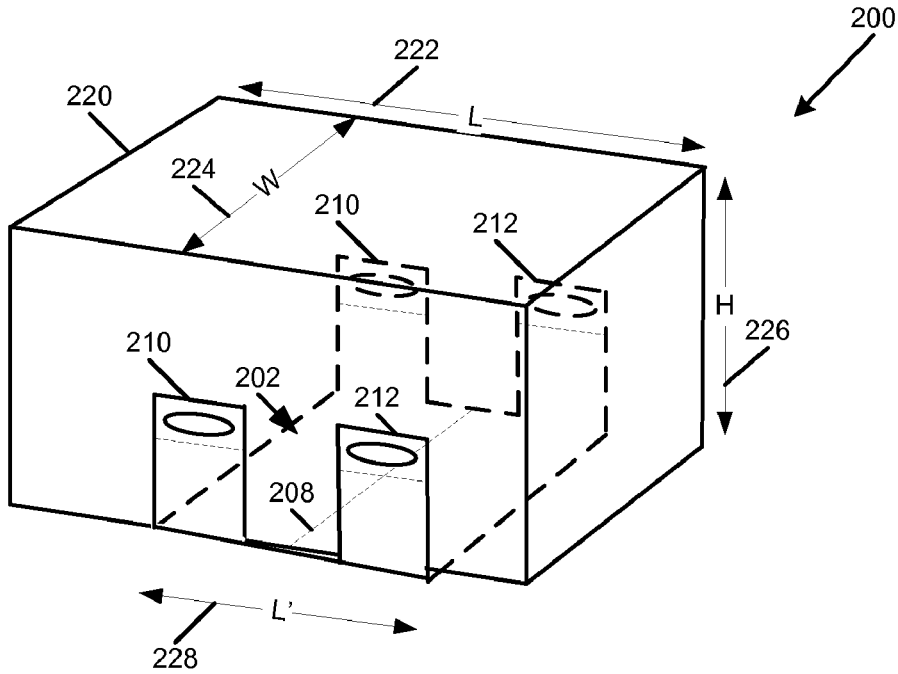
FIGS. 2 and 3 are diagrams illustrating a second particular embodiment of a server system lifting device.
Figure 3:
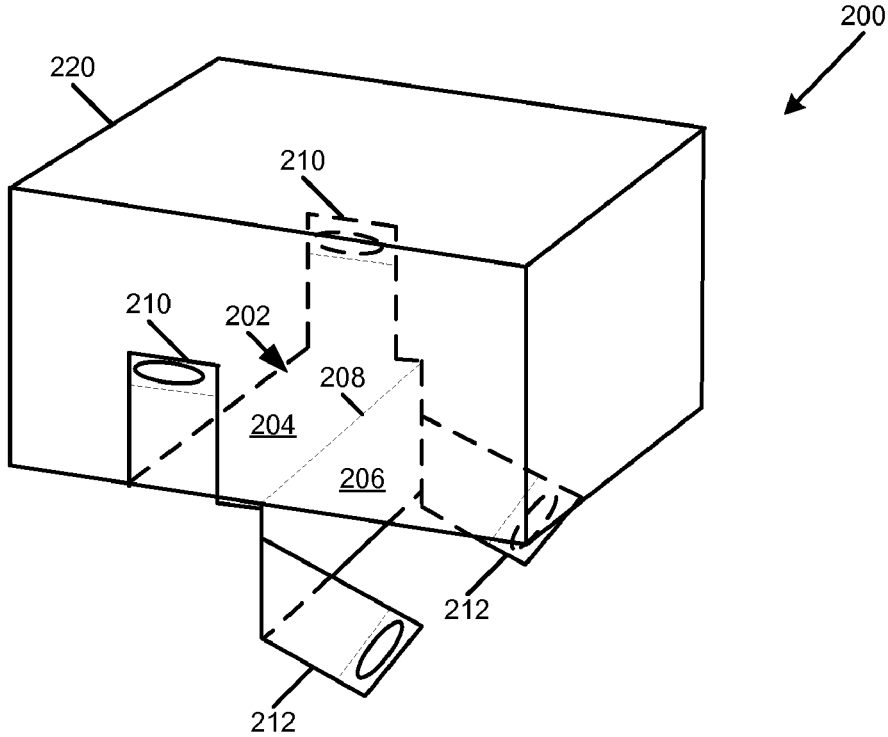

FIGS. 2-3 illustrate a second particular embodiment of a server system lifting device 200. The server system lifting device 200 includes a bearing area 202 to support a server system chassis 220. The bearing area 202 is foldable at a midline 208 that extends between opposite sides of the bearing area 202. The midline 208 defines a front portion of the bearing area 202 and a rear portion of the bearing area 202. The lifting device 200 also includes a plurality of handles 210, 212. The plurality of handles includes two front handles 210 coupled to opposite sides of the front portion of the bearing area 202. Additionally, the plurality of handles includes two rear handles 212 coupled to opposite sides of the rear portion of the bearing area 202. In one embodiment, the plurality of handles 210, 212 can be affixed to the bearing area 202. In another embodiment, the bearing area 202 and the plurality of handles 210, 212 can be of unitary construction.

The server system chassis 220 is characterized by a length 222 that extends from an open end of the server system chassis 220 adapted to receive one or more servers to a rear edge of the server system chassis 220. The server system chassis 220 is also characterized by a width 224 and a height 226. The bearing area 202 has a width extending in a direction of the midline 208, where the width of the bearing area 202 is greater than or equal to the width 224 of the server system chassis 220. In addition, the bearing area 202 is characterized by an additional length L' 228, such that the two front handles 210 are forward of a center of gravity of the server system chassis 220, and the two rear handles 212 are posterior to the center of gravity of the server system chassis 220, when the midline 208 is positioned approximately underneath or otherwise approximately aligned with the center of gravity of the server system chassis 220.

Figure 4:
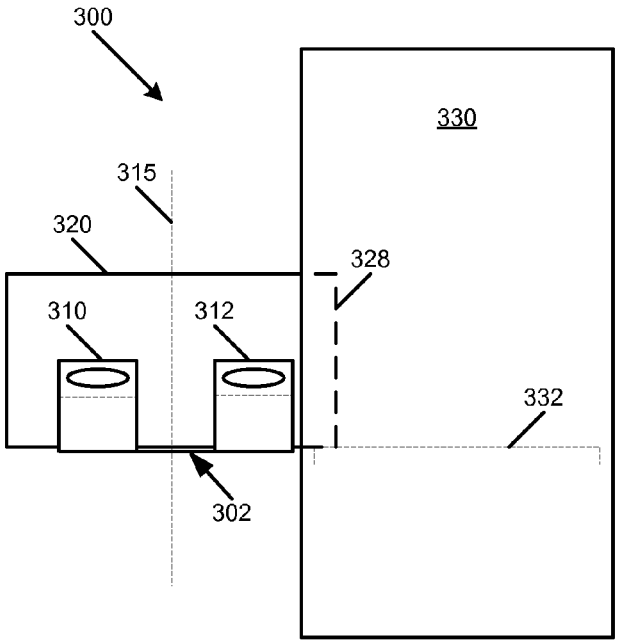
FIGS. 4-7 are diagrams illustrating a third particular embodiment of a server system lifting device.

Further, the additional length L' 228 is sized to allow a portion of the server system chassis 220, such as a rear portion, to be inserted into and supported by a server rack before the rear portion of the bearing area 202 is removed from contact with the server system chassis, as illustrated in FIG. 4. The bearing area 202 does not extend to the rear edge of the server system chassis 220 when the midline 208 is positioned approximately underneath or otherwise approximately aligned with the center of gravity of the server system chassis 220. This allows a portion of the server system chassis 220 to be inserted into and supported by a server rack prior to folding the bearing area 202 at the midline 208, as illustrated further in FIGS. 4-7.

The bearing area 202 and the plurality of handles 210, 212 are of sufficient strength to support the weight of the server system chassis 220 without breakdown, such as tearing or disintegration, when the handles 210, 212 are pulled to lift the server system chassis 220 via the bearing area 202. For example, the bearing area 202 and the plurality of handles 210, 212 can be of sufficient strength to support a weight from approximately 90 kg to approximately 200 kg. In addition, each portion 204, 206 of the bearing area 202 is of sufficient strength to support at least part of the weight of the server system chassis 220 when the other portion is removed from contact with the server system chassis 220 by folding the bearing area 202 at the midline 208. For instance, as illustrated in FIG. 3, the bearing area 202 is foldable at the midline 208, such that a portion of the bearing area 202, such as the rear portion 206, is removed or substantially removed from contact with the server system chassis 220 when the bearing area 202 is folded at the midline 208. In one embodiment, the bearing area 202 can be substantially rigid except for a crease that runs at the midline 208.

FIGS. 4-7 illustrate a third particular embodiment of a server system lifting device 300. In an illustrative embodiment, the server system chassis 320 can be supported via a bearing area and can be lifted via a plurality of handles 310, 312 coupled to the bearing area 302. The bearing area 302 is characterized by a length such that the two front handles 310 are forward of a center of gravity 315 of the server system chassis 320, and the two rear handles 312 are posterior to the center of gravity 315 of the server system chassis 320, when a midline, such as the midline 108 illustrated in FIG. 1, is approximately aligned with the center of gravity 315 of the server system chassis 320.

Figure 5:
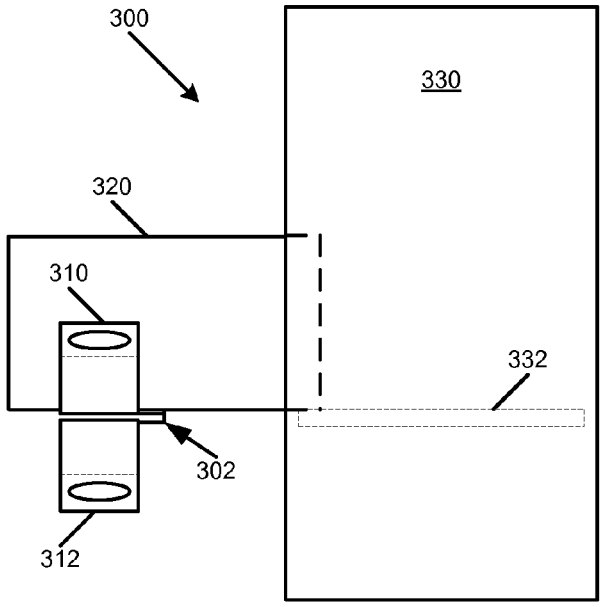

A rear portion 328 of the server system chassis 320 can be inserted into a server rack 330. For instance, as illustrated in FIG. 4, the rear portion 328 can be inserted into the server rack 330 until supported by a plurality of rails, L-brackets or other supports 332 coupled to the inside of the server rack 330. Once the rear handles 312 of the lifting device contact or nearly contact the server rack 330, the bearing area 302 can be folded at the crease such that a rear portion of the bearing area 302 is removed or substantially removed from contact with the server rack chassis 320, as illustrated in FIG. 5. The portion of the server system chassis 320 that is still external to the server rack 330 can be supported via the front handles 310 and a front portion of the bearing area 302.

Figure 6:
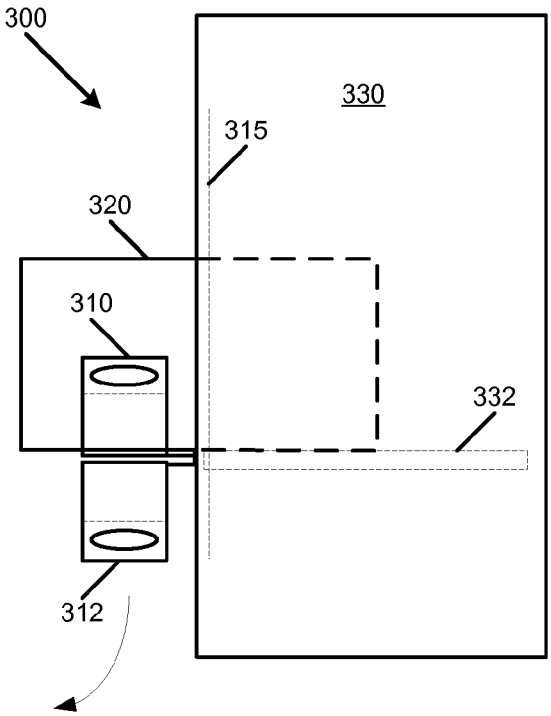
Figure 7:
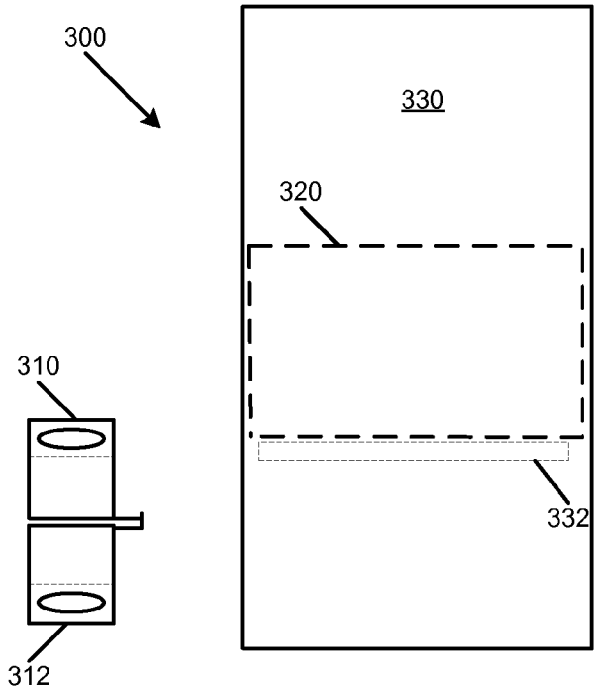

The server system chassis 320 can be advanced into the server rack 330 until the center of gravity 315 is supported by the plurality of supports 332 inside the server rack 330, as illustrated in FIG. 6. The lifting device can then be removed or substantially removed from contact with the server system chassis 320, and the server system chassis 320 can be fully inserted or advanced to a desired depth into the server rack 330, as illustrated in FIG. 7.

Figure 8:
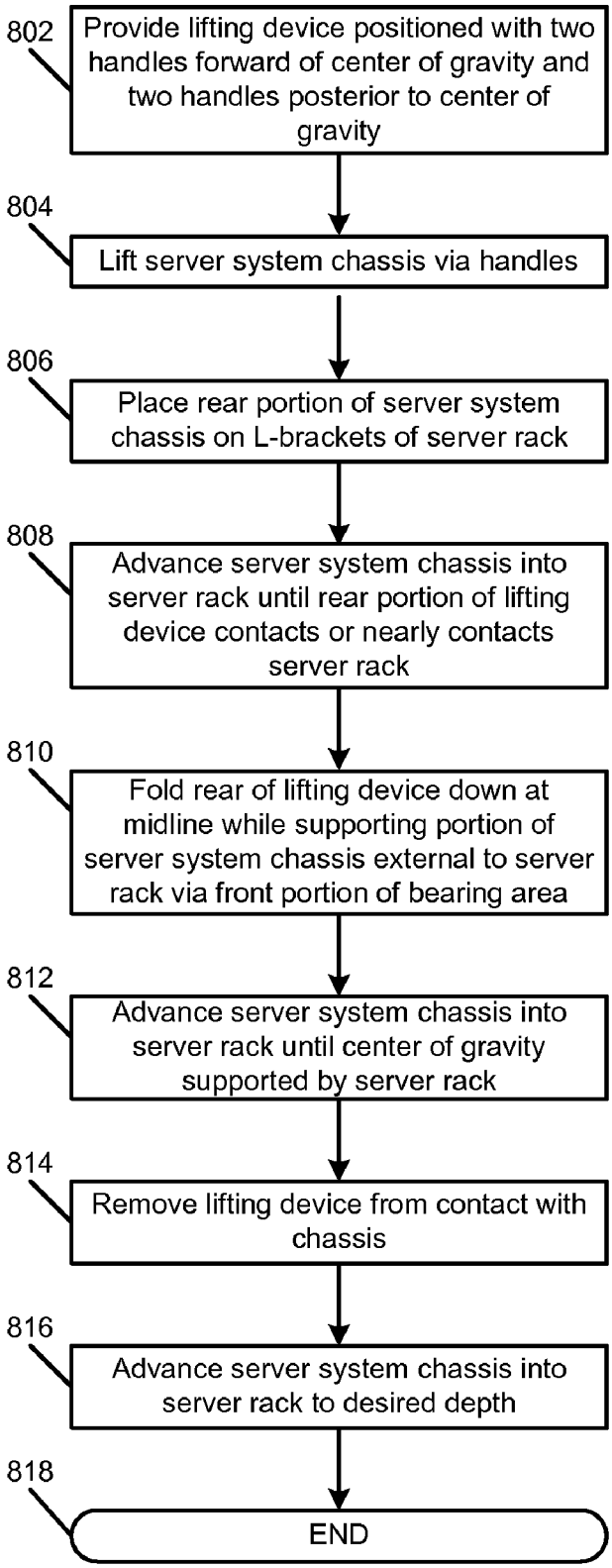
FIG. 8 is a flow diagram illustrating a particular embodiment of a method of lifting a server system.

FIG. 8 is a flow diagram illustrating a particular embodiment of a method of lifting a server system. At block 802, a server system lifting device is provided. In a particular embodiment, the server system lifting device is positioned under the server system chassis, such that two handles coupled to the bearing area are forward of a center of gravity of the server system chassis, and two handles coupled to the bearing area are posterior to the center of gravity of the server system chassis. The server system lifting device can include any of the embodiments described with respect to FIGS. 1-5.

For example, a midline defining a front portion of the bearing area and a rear portion of the bearing area can be approximately aligned with a center of gravity of the server system chassis. The front handles can be coupled to opposite sides of the front portion of the bearing area, and the rear handles can be coupled to opposite sides of the rear portion of the bearing area. The midline can include a crease that extends between the opposite sides of the lifting device, as illustrated in FIG. 1 or FIGS. 2-3. In a particular embodiment, the lifting device can have a length that does not extend to a rear edge of the server system of the server system chassis when the midline is approximately aligned with the center of gravity, as illustrated in FIG. 4.

Proceeding to block 804, the server system chassis can be lifted via the front and rear handles. Continuing to block 806, a rear portion of the server system chassis can be inserted into a server rack and placed on L-brackets or other supports inside the server rack. Advancing to block 808, the server system chassis is advanced until the rear portion of the bearing area, the rear handles, or a combination thereof, contacts or nearly contacts the server rack. At block 810, the bearing area can be folded at its midline, such that the rear portion of the bearing area is removed or substantially removed from contact with the server system chassis, while the portion of the server system chassis that is not supported by the server rack is supported via the front portion of the bearing area.

Moving to block 812, the server system chassis is advanced further into the server rack until the center of gravity of the server system chassis is supported by the server rack. Proceeding to block 814, the lifting device is removed or substantially removed from contact with the server system chassis. Continuing to block 816, the server system chassis is advanced into the server rack completely or to a desired depth. The method terminates at 818.

In an illustrative, non-limiting example, the lifting device can be placed under the server system chassis during packing, such as between the server system chassis and foam or other packing materials underneath a side of the server system chassis. A box or other outer packing container, as well as packing materials on a top side, front side, other non-bottom side, or any combination thereof, of the server system chassis can be removed prior to lifting the server system chassis via the lifting device. Components such as server blades, fans, other components, or any combination thereof, can be removed before lifting and can be reinstalled once the server system chassis is inserted into a server rack.

Many different aspects and embodiments are possible. Some of those aspects and embodiments are described below. After reading this specification, skilled artisans will appreciate that those aspects and embodiments are only illustrative and do not limit the scope of the present invention.

In a first aspect, a server system lifting device includes a bearing area foldable at a midline. The bearing area includes a front portion and a rear portion that are defined by the midline. The server system lifting device also includes a plurality of handles coupled to the bearing area. The plurality of handles include two front handles coupled to opposite sides of the front portion of the bearing area and two rear handles coupled to opposite sides of the rear portion of the bearing area. The midline extends between the opposite sides. The bearing area is characterized by a width greater than or equal to a width of a server system chassis and a length such that the two forward handles are forward of a center of gravity of the server system chassis, and the two rear handles are posterior to the center of gravity of the server system chassis, when the midline is approximately aligned with the center of gravity of the server system chassis.

In an embodiment of the first aspect, the bearing area and the plurality of handles can comprise a unitary construction. For instance, the bearing area and the plurality of handles can comprise fiberboard or plastic, such as corrugated fiberboard or corrugated plastic. In some embodiments, the bearing area and the plurality of handles can comprise cross-corrugated fiberboard or cross-corrugated plastic.

In another embodiment of the first aspect, the server system lifting device of claim 1, wherein the plurality of handles can be affixed to the bearing area.

In a further embodiment of the first aspect, a crease can extend along the midline. For example, the crease can comprise a pleat. In another example, the crease can comprise a plurality of openings in a material of the bearing area.

In still another embodiment of the first aspect, the front portion of the bearing area and the rear portion of the bearing area are substantially rigid. Further, the plurality of handles can be reinforced. In one example of the first aspect, the bearing area and the plurality of handles can be adapted to support from approximately 135 kg (300 lbs.) to approximately 680 kg (1500 lbs.).

In a further embodiment of the first aspect, the length is sized to allow, when the midline is approximately aligned with the center of gravity of the server system chassis, a portion of the server system chassis to be inserted into and supported by a server rack before the rear portion of the lifting device is removed from contact with the server system chassis.

In a second aspect, a method of using a server system lifting device includes providing a sever system lifting device, the server system lifting device including a bearing area positioned under the server system chassis, wherein a midline defining a front portion of the bearing area and a rear portion of the bearing area is approximately aligned with a center of gravity of the server system chassis. The method also includes lifting the server system via a plurality of handles coupled to the bearing area. The plurality of handles include two front handles forward of the center of gravity, the two front handles coupled to opposite sides of the front portion of the bearing area, and two rear handles posterior to the center of gravity, the two rear handles coupled to opposite sides of the rear portion of the bearing area. The midline extends between the opposite sides. The method also includes inserting a portion of the server system chassis into the server rack until the portion of the server system chassis is supported by the server rack and folding the bearing area at the midline, such that the rear portion of the bearing area is substantially removed from contact with the server system chassis.

In an embodiment of the second aspect, the method can also include supporting a portion of the server system chassis external to the server rack via the front portion of the bearing area and the front handles, while the bearing area is folded at the midline.

In another embodiment of the second aspect, the method can also include advancing the server system chassis into the server rack until the center of gravity of the server rack chassis is supported by the server rack. In an additional embodiment of the second aspect, the method can include removing the server system lifting device from contact with the server system chassis. Further, the method can include advancing the server system chassis to a desired depth within the server rack.

In another embodiment of the second aspect, the server rack includes a plurality of supports to support the server system chassis, such as L-brackets or rails.

In another embodiment of the second aspect, the lifting device can be placed under the server system chassis during packing of the server system.

Note that not all of the activities described above in the general description or the examples are required, that a portion of a specific activity may not be required, and that one or more further activities may be performed in addition to those described. Still further, the order in which activities are listed are not necessarily the order in which they are performed.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Many other embodiments may be apparent to those of skill in the art upon reviewing the disclosure. Other embodiments may be used and derived from the disclosure, such that a structural substitution, logical substitution, or another change may be made without departing from the scope of the disclosure. Accordingly, the disclosure is to be regarded as illustrative rather than restrictive.

Certain features are, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A server system lifting device, comprising:

a bearing area foldable at a midline, wherein the bearing area includes a front portion and a rear portion that are defined by the midline; and a plurality of handles coupled to the bearing area, the plurality of handles including two front handles coupled to opposite sides of the front portion of the bearing area and two rear handles coupled to opposite sides of the rear portion of the bearing area, wherein the midline extends between the opposite sides and the midline enables either the front portion of the bearing area to fold away from the rear portion of the bearing area or the rear portion of the bearing area to fold away from the front portion of the bearing area;

wherein the bearing area includes:

a width greater than or equal to a width of a server system chassis; and a length such that the two front handles are forward of a center of gravity of the server system chassis, and the two rear handles are posterior to the center of gravity of the server system chassis, when the midline is approximately aligned with the center of gravity of the server system chassis, wherein one of the front portion and the rear portion is able to physically support the server system chassis when the other one of the front portion and the rear portion is folded down and away from the server system chassis.

2. The server system lifting device of claim 1, wherein the bearing area and the plurality of handles comprise a unitary construction.

3. The server system lifting device of claim 2, wherein the bearing area and the plurality of handles comprise fiberboard or plastic.

4. The server system lifting device of claim 3, wherein the bearing area and the plurality of handles comprise corrugated fiberboard or corrugated plastic.

5. The server system lifting device of claim 4, wherein the bearing area and the plurality of handles comprise cross-corrugated fiberboard or cross-corrugated plastic.

6. The server system lifting device of claim 1, wherein the handles are affixed to the bearing area.

7. The server system lifting device of claim 1, further comprising a crease extending along the midline.

8. The server system lifting device of claim 7, wherein the crease comprises a pleat.

9. The server system lifting device of claim 7, wherein the crease comprises a plurality of openings in a material of the bearing area.

10. The server system lifting device of claim 1, wherein the front portion of the bearing area and the rear portion of the bearing area are substantially rigid.

11. The server system lifting device of claim 1, wherein the plurality of handles are reinforced based on a material of the plurality of handles being folded over at an end of each of the plurality of handles and the material being doubled at the plurality of handles.

12. The server system lifting device of claim 1, wherein the bearing area and the plurality of handles are adapted to support from approximately 135 kg (300 lbs.) to approximately 680 kg (1500 lbs.).

13. The server system lifting device of claim 1, wherein the length is sized to allow, when the midline is approximately aligned with the center of gravity of the server system chassis, a portion of the server system chassis to be inserted into and supported by a server rack before the rear portion of the lifting device is removed from contact with the server system chassis.

14. A server system lifting device, comprising:

a bearing area foldable at a midline, wherein the bearing area includes a front portion and a rear portion that are defined by the midline; and a plurality of handles coupled to the bearing area, the plurality of handles including two front handles coupled to opposite sides of the front portion of the bearing area and two rear handles coupled to opposite sides of the rear portion of the bearing area, wherein the midline extends between the opposite sides and the midline enables either the front portion of the bearing area to fold away from the rear portion of the bearing area or the rear portion of the bearing area to fold away from the front portion of the bearing area, and wherein the plurality of handles comprise a material same as the bearing area, the plurality of handles are reinforced based on the material being folded over at an end of each of the plurality of handles, and each of the plurality of handles including an opening in the material to create a handle area;

wherein the bearing area includes:

a width greater than or equal to a width of a server system chassis; and a length such that the two front handles are forward of a center of gravity of the server system chassis, and the two rear handles are posterior to the center of gravity of the server system chassis, when the midline is approximately aligned with the center of gravity of the server system chassis.

15. The server system lifting device of claim 14, wherein the bearing area and the plurality of handles comprise fiberboard or plastic.

16. The server system lifting device of claim 15, wherein the bearing area and the plurality of handles comprise corrugated fiberboard or corrugated plastic.

17. The server system lifting device of claim 16, wherein the bearing area and the plurality of handles comprise cross-corrugated fiberboard or cross-corrugated plastic.

18. The server system lifting device of claim 14, wherein a crease extending along the midline, and the crease comprises a plurality of openings in the material of the bearing area.

19. The server system lifting device of claim 14, wherein the length is sized to allow, when the midline is approximately aligned with the center of gravity of the server system chassis, a portion of the server system chassis to be inserted into and supported by a server rack before the rear portion of the lifting device is removed from contact with the server system chassis.

20. A server system lifting device, comprising:

a bearing area foldable at a midline, wherein the bearing area includes a front portion and a rear portion that are defined by a plurality of slits along the midline; and a plurality of handles coupled to the bearing area, the plurality of handles including two front handles coupled to opposite sides of the front portion of the bearing area and two rear handles coupled to opposite sides of the rear portion of the bearing area, wherein the midline extends between the opposite sides and the midline enables either the front portion of the bearing area to fold away from the rear portion of the bearing area or the rear portion of the bearing area to fold away from the front portion of the bearing area;

wherein the bearing area includes:

a width greater than or equal to a width of a server system chassis; and a length such that the two front handles are forward of a center of gravity of the server system chassis, and the two rear handles are posterior to the center of gravity of the server system chassis, when the midline is approximately aligned with the center of gravity of the server system chassis, wherein one of the front portion and the rear portion is able to physically support the server system chassis when the other one of the front portion and the rear portion is folded down and away from the server system chassis.

* * * * *